US010767334B2

(12) United States Patent
Perko et al.

(10) Patent No.: US 10,767,334 B2
(45) Date of Patent: Sep. 8, 2020

(54) GROUTED HELICAL PILE

(71) Applicant: Magnum Piering, Inc., West Chester, OH (US)

(72) Inventors: Howard A. Perko, Fort Collins, CO (US); Bernard Brian Dwyer, Loveland, OH (US); Matthew Houliston, Fort Thomas, KY (US)

(73) Assignee: Magnum Piering, Inc., West Chester, OH (US)

( * ) Notice: Subject to any disclaimer, the term of this patent is extended or adjusted under 35 U.S.C. 154(b) by 0 days.

(21) Appl. No.: 16/289,908

(22) Filed: Mar. 1, 2019

(65) Prior Publication Data

US 2019/0271131 A1 Sep. 5, 2019

Related U.S. Application Data

(60) Provisional application No. 62/637,442, filed on Mar. 2, 2018.

(51) Int. Cl.
*E02D 5/80* (2006.01)
*E02D 7/22* (2006.01)
(Continued)

(52) U.S. Cl.
CPC ..... *E02D 5/56* (2013.01); *E02D 5/36* (2013.01); *E02D 2250/003* (2013.01); *E02D 2250/0038* (2013.01)

(58) Field of Classification Search
CPC .... E02D 5/40; E02D 5/41; E02D 5/42; E02D 5/43; E02D 5/44; E02D 5/80; E02D 27/50; E02D 5/22; E02D 5/30; E02D 5/385; E02D 5/54; E02D 7/02; E02D 13/04; E02D 27/525; E02D 2250/0038; E02D 27/18; E02D 27/22; E02D 5/56; E02D 7/22; E02D 7/24; E02D 7/18; E02D 5/02; E02D 5/72; E02D 27/12; E02D 27/20; E02D 11/00; E02D 7/00; E02D 9/00; E02D 13/10; E02D 23/00; E02D 29/063; E02D 5/801; B63B 21/24; B63B 21/26; B63B 21/50;
(Continued)

(56) References Cited

U.S. PATENT DOCUMENTS 2,729,067 A * 1/1956 Patterson ..... E21B 10/44 405/236
3,016,117 A * 1/1962 Petersen ..... E02D 5/801 52/157
(Continued)

FOREIGN PATENT DOCUMENTS

JP 2003064673 A * 3/2003
WO 2003074794 2/2002

*Primary Examiner* — Edwin J Toledo-Duran
(74) *Attorney, Agent, or Firm* — Wood Herron & Evans LLP

(57) ABSTRACT

Provided is a helical pile having an elongated shaft, at least one helical blade on the shaft having a leading edge and a trailing edge, and a displacement paddle extending outward from the shaft longitudinally positioned between the leading and trailing edges of the blade to push away soil to create a grout channel surrounding the shaft. At least one grout propeller may be provided on the shaft, having at least one blade pitched an opposite direction from the helical blade to propel grout downward in the grout channel as the pile rotates.

19 Claims, 9 Drawing Sheets

(51) Int. Cl.
*E02D 5/56* (2006.01)
*E02D 5/36* (2006.01)

(58) Field of Classification Search
CPC ..... E02B 17/02; E02B 17/027; E02B 17/00; E02B 3/06; E21B 41/08; E21D 21/00; A01G 17/16; E04H 17/26
USPC ..... 405/227–257, 258.1–259.6, 302.4; 52/157; 175/394
See application file for complete search history.

(56) References Cited

U.S. PATENT DOCUMENTS 3,243,962 A * 4/1966 Ratliff ..... C09K 17/06 405/266
3,645,055 A * 2/1972 Roza ..... E02D 5/801 52/157
3,810,364 A 5/1974 Johnson
3,999,391 A 12/1976 Meredith
4,290,245 A * 9/1981 Pardue, Jr. ..... E02D 5/801 52/157
4,467,575 A * 8/1984 Dziedzic ..... E02D 5/801 405/259.1
RE32,076 E * 2/1986 Dziedzic ..... E02D 5/801 175/400
4,653,245 A * 3/1987 Webb ..... E02D 5/801 175/394
4,742,656 A * 5/1988 Farmer ..... E02D 5/801 175/394
5,171,107 A 12/1992 Hamilton et al.
5,265,982 A * 11/1993 Burtelson ..... E02D 5/801 405/259.1
5,575,593 A * 11/1996 Raaf ..... E02D 5/30 405/232
5,653,069 A * 8/1997 Dziedzic ..... E02D 5/74 405/244
5,707,180 A 1/1998 Vickars et al.
5,722,498 A * 3/1998 Van Impe ..... E02D 5/36 175/394
5,904,447 A * 5/1999 Sutton ..... B09C 1/00 175/323
5,919,005 A * 7/1999 Rupiper ..... B09C 1/00 175/323
5,934,836 A 8/1999 Rupiper et al.
6,033,152 A 3/2000 Blum
6,058,662 A * 5/2000 Perko ..... E02D 5/801 405/232
6,264,402 B1 7/2001 Vickars et al.
6,615,554 B2 * 9/2003 Rupiper ..... E02D 5/801 405/252.1
6,722,821 B1 4/2004 Perko et al.
7,018,139 B1 * 3/2006 Slemons ..... E02D 5/56 405/231
7,198,434 B2 4/2007 Blum
7,338,232 B2 * 3/2008 Nasr ..... E02D 5/46 405/233
8,033,757 B2 10/2011 Stroyer
8,926,228 B2 * 1/2015 Stroyer ..... E02D 5/36 405/233
9,506,295 B1 11/2016 Blum et al.
9,512,588 B2 12/2016 Blum et al.
10,077,893 B1 * 9/2018 Abraham ..... F21V 33/0052
2001/0045067 A1 * 11/2001 Cognon ..... C04B 28/10 52/155
2002/0174606 A1 * 11/2002 Hunt ..... E04D 13/0648 52/79.1
2005/0074298 A1 * 4/2005 Jones ..... E02D 5/523 405/252.1
2008/0302028 A1 * 12/2008 Lewenhoff ..... E02D 7/22 52/157
2009/0294181 A1 * 12/2009 Barbera ..... E21B 10/44 175/394
2010/0263928 A1 * 10/2010 Massari ..... E02D 7/22 175/19
2012/0087740 A1 * 4/2012 Stroyer ..... E02D 5/52 405/241
2014/0286712 A1 * 9/2014 Lutenegger ..... E02D 5/526 405/252.1
2015/0063910 A1 * 3/2015 Meltsov ..... F03B 13/264 405/21
2015/0117960 A1 4/2015 Kemp et al.
2016/0186403 A1 * 6/2016 Tomchesson ..... E02D 5/526 405/244
2017/0159256 A1 * 6/2017 Li ..... E02D 5/28
2017/0198453 A1 * 7/2017 Brown ..... E02D 5/28
2017/0218590 A1 * 8/2017 Raposo ..... E02D 5/56
2018/0258602 A1 * 9/2018 Kemp ..... E02D 7/22

* cited by examiner

GROUTED HELICAL PILE

CROSS-REFERENCE

This application claims priority to U.S. Provisional Patent Application No. 62/637,442, filed Mar. 2, 2018, and incorporates the same herein by reference.

TECHNICAL FIELD

The present invention relates to a helical pile foundation system that, as it is driven into the ground, forms a channel that is filled with flowable grout that solidifies around the pile in situ.

BACKGROUND

Piles are well known to provide support for foundations, piering to lift sunken foundations, or to tie back walls or provide other mounting supports, for example. It is also well known to use piles having helical blades that cut into the ground as the pile is rotationally driven into place. Such systems include an elongated shaft in the form of a solid rod or hollow pipe, to which are mounted one or more helical blades. The proximal or trailing end of the shaft is caused to rotate, such as by application of torque from the shaft of a torque motor driver attached thereto, so as to rotate the helical blades into the ground, like a screw. Examples of helix blade systems are shown in my U.S. Pat. No. 6,058,662, and in U.S. Pat. Nos. 5,171,107; 3,999,391; and 3,810,364, among others. In many cases, the blades are required to be driven into the ground to a depth that is deeper than the length of the shaft supporting the blade or blades. In such cases, a second or extension shaft may be attached at its distal or leading end to the trailing end of the preceding shaft, such as with a socket or collar mounted to the end of one of the shafts and receiving the adjacent end of the other shaft therein. Torque is then applied to the trailing end of the second shaft to thereby rotate the blade deeper into the ground. Successive extension shafts may be used.

It is also well known to displace a column of soil and to fill that column with flowable grout, such as neat cement, as the shaft is drawn down through a body of soil as the helix at the lower end of the shaft is screwed into the soil. Examples are shown in U.S. Pat. Nos. 5,707,180, 6,264,402, and U.S. Patent Application Publication No. 2015/0117960A1 among others. These patents disclose the use of a disc that is fixed to an axial location on the pile shaft, which displaces soil and/or acts as a grout-pushing piston as the pile is driven into place. Other patents disclose the use of ground clearing devices affixed within and amongst the helical blades to displace soil and provide a grout channel. Examples are U.S. Pat. No. 8,926,228 and U.S. Patent Application Publication No. 2017/0218590A1, among others. Other devices have been used where grout is pushed through the hollow pile shaft to extrude through openings at various locations to create a pressurized grout channel around the pile shaft. Examples are shown in U.S. Pat. Nos. 3,243,962, 6,058,662, and 7,338,232, among others.

SUMMARY OF THE INVENTION

One embodiment provides a helical pile having an elongated shaft, at least one helical blade on the shaft having a leading edge and a trailing edge, and a displacement paddle extending outward from the shaft longitudinally positioned between the leading and trailing edges of the blade to push away soil to create a grout channel surrounding the shaft.

Another embodiment provides at least one grout propeller on the shaft, having at least one blade pitched an opposite direction from the helical blade to propel grout downward in the grout channel as the pile rotates Other aspects, features, benefits, and advantages of the present invention will become apparent to a person of skill in the art from the detailed description of various embodiments with reference to the accompanying drawing figures, all of which comprise part of the disclosure.

BRIEF DESCRIPTION OF THE DRAWINGS

Like reference numerals are used to indicate like parts throughout the various drawing figures, wherein.

DETAILED DESCRIPTION

Figure 1:
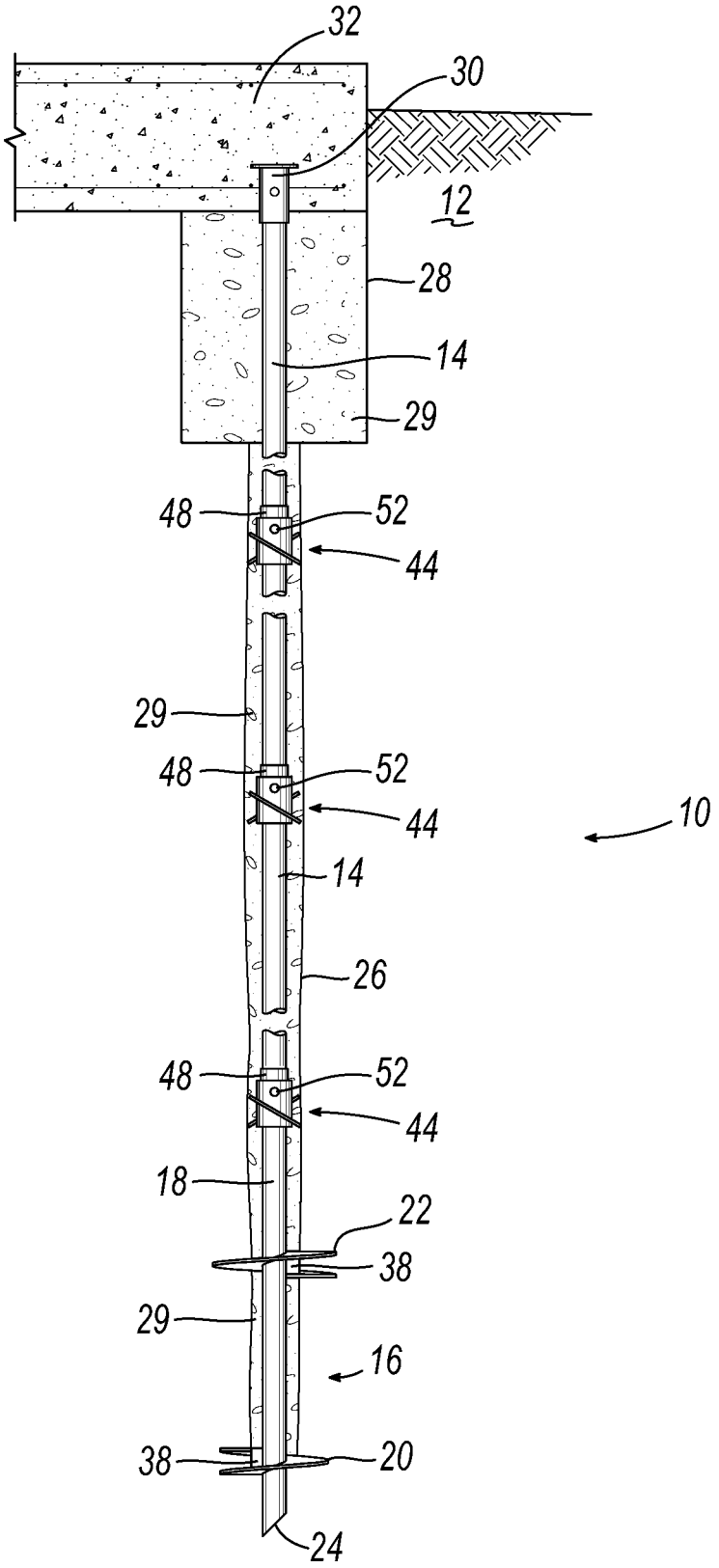
FIG. 1 is a side sectional view showing a helical pile according to one or more aspects or embodiments of the present invention to form a grouted pier post for a structural foundation including grout propellers at each coupling and grout displacement paddles at each helix.

With reference to the drawing figures, this section describes particular embodiments and their detailed construction and operation. Throughout the specification, reference to "one embodiment," "an embodiment," or "some embodiments" means that a particular described feature, structure, or characteristic may be included in at least one embodiment. Thus, appearances of the phrases "in one embodiment," "in an embodiment," or "in some embodiments" in various places throughout this specification are not necessarily all referring to the same embodiment. Furthermore, the described features, structures, and characteristics may be combined in any suitable manner in one or more embodiments. In view of the disclosure herein, those skilled in the art will recognize that the various embodiments can be practiced without one or more of the specific details or with other methods, components, materials, or the like. In some instances, well-known structures, materials, or operations are not shown or not described in detail to avoid obscuring aspects of the embodiments.

Figure 2:
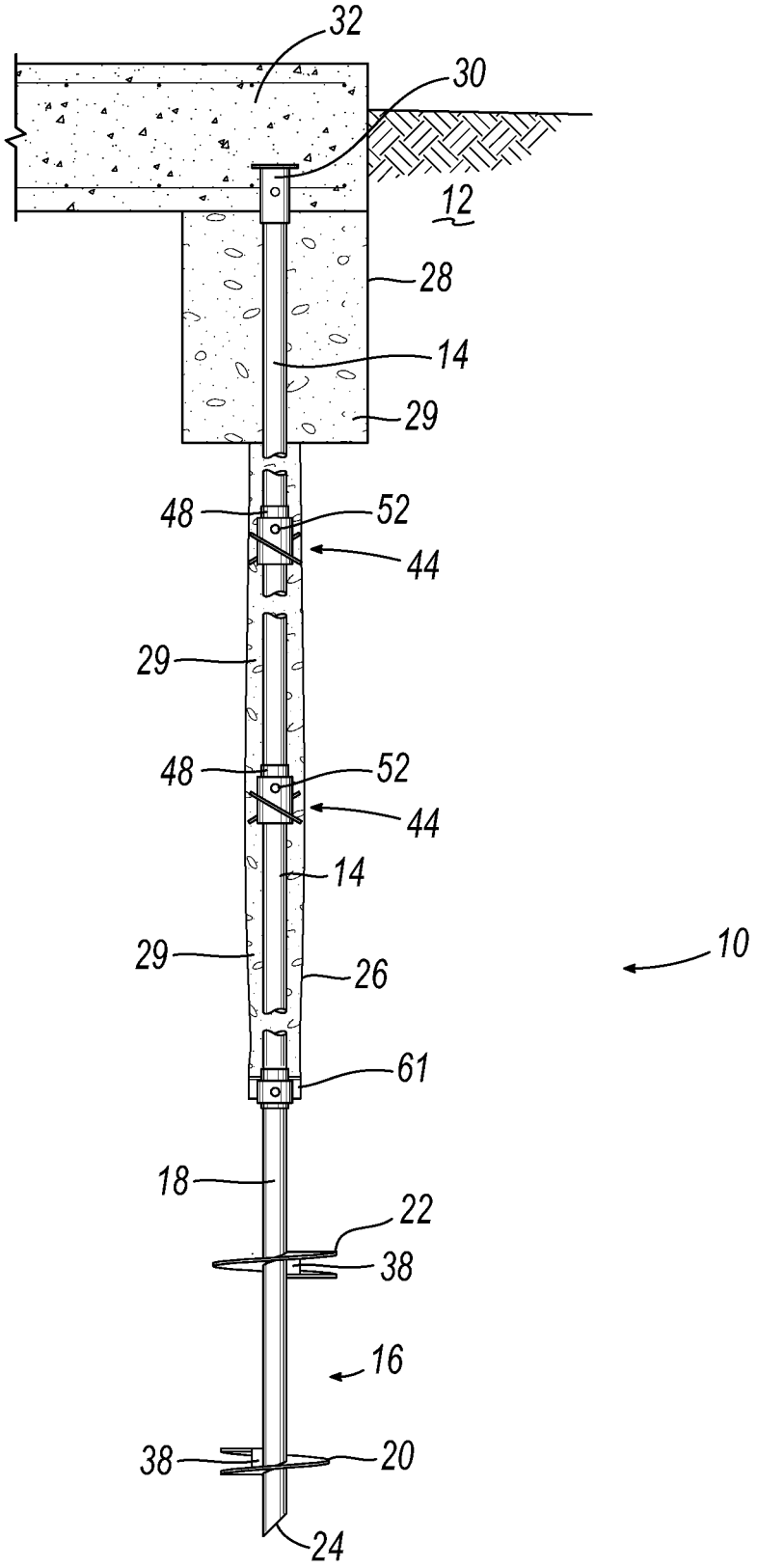
FIG. 2 is a side sectional view showing a helical pile according to one or more aspects or embodiments of the present invention to form a grouted pier post for a structural foundation including grout propellers and a prior art grout pushing piston disc.
Figure 3:
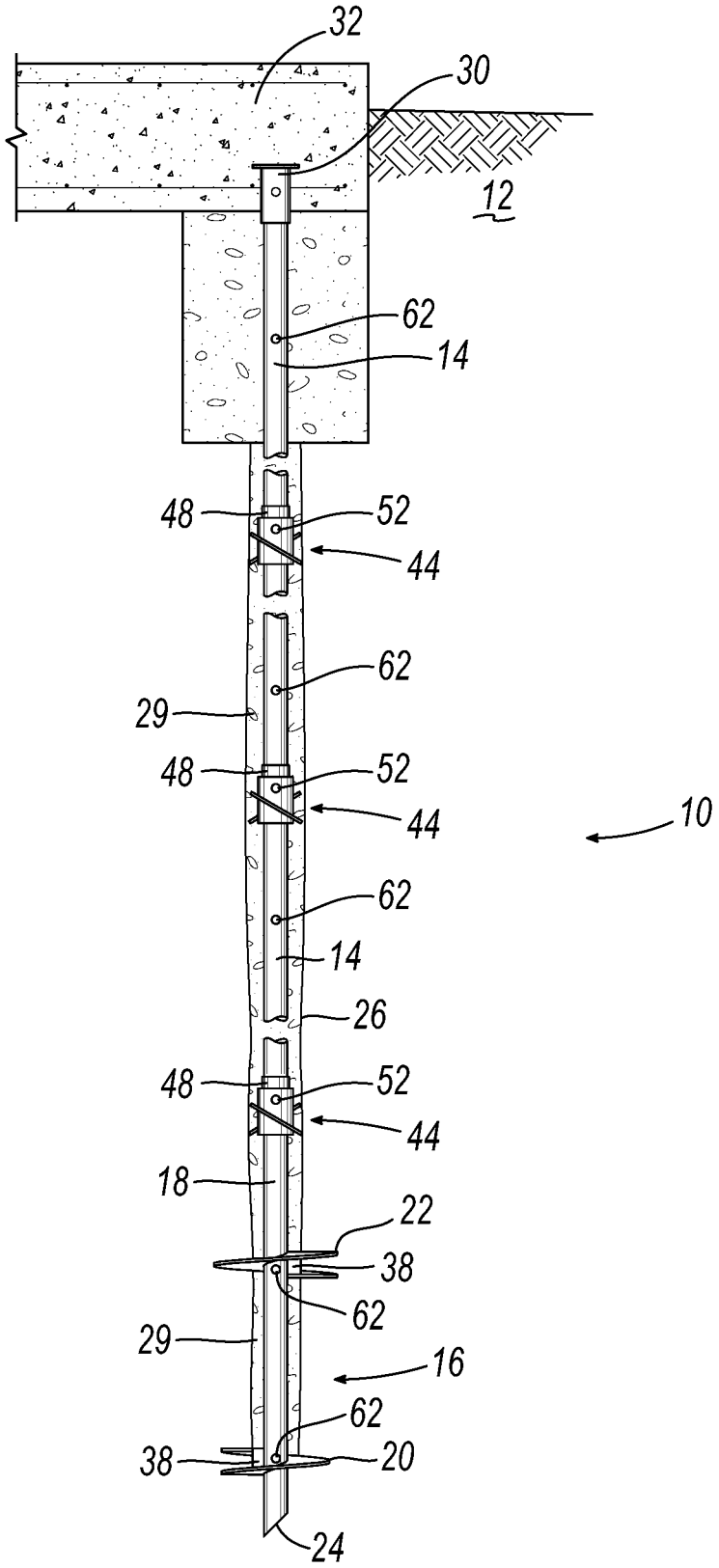
FIG. 3 is a side sectional view showing a helical pile according to one or more aspects or embodiments of the present invention to form a grouted pier post for a structural foundation including grout propellers and one or more prior art holes in the pile shaft through which grout can be pumped.
Figure 4:
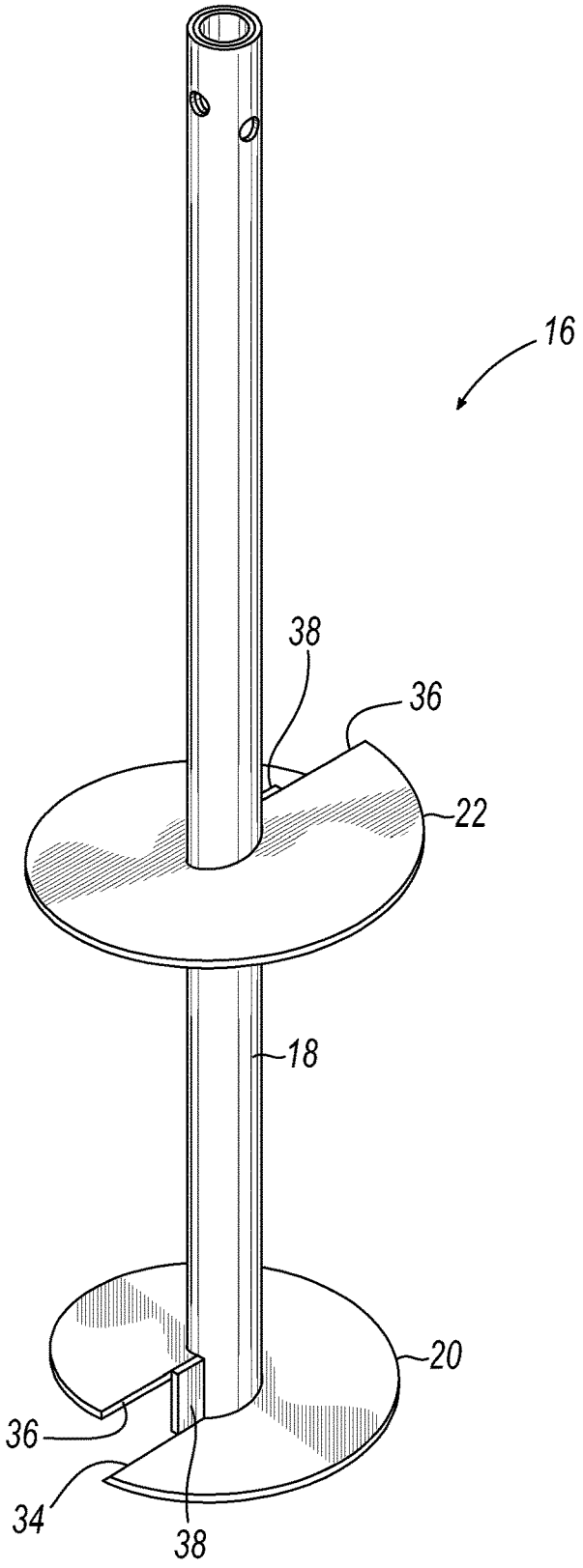
FIG. 4 is an isometric view of a lead section of a helical pile including two soil-displacing or grout displacing paddles according to an embodiment of the present invention.
Figure 5:
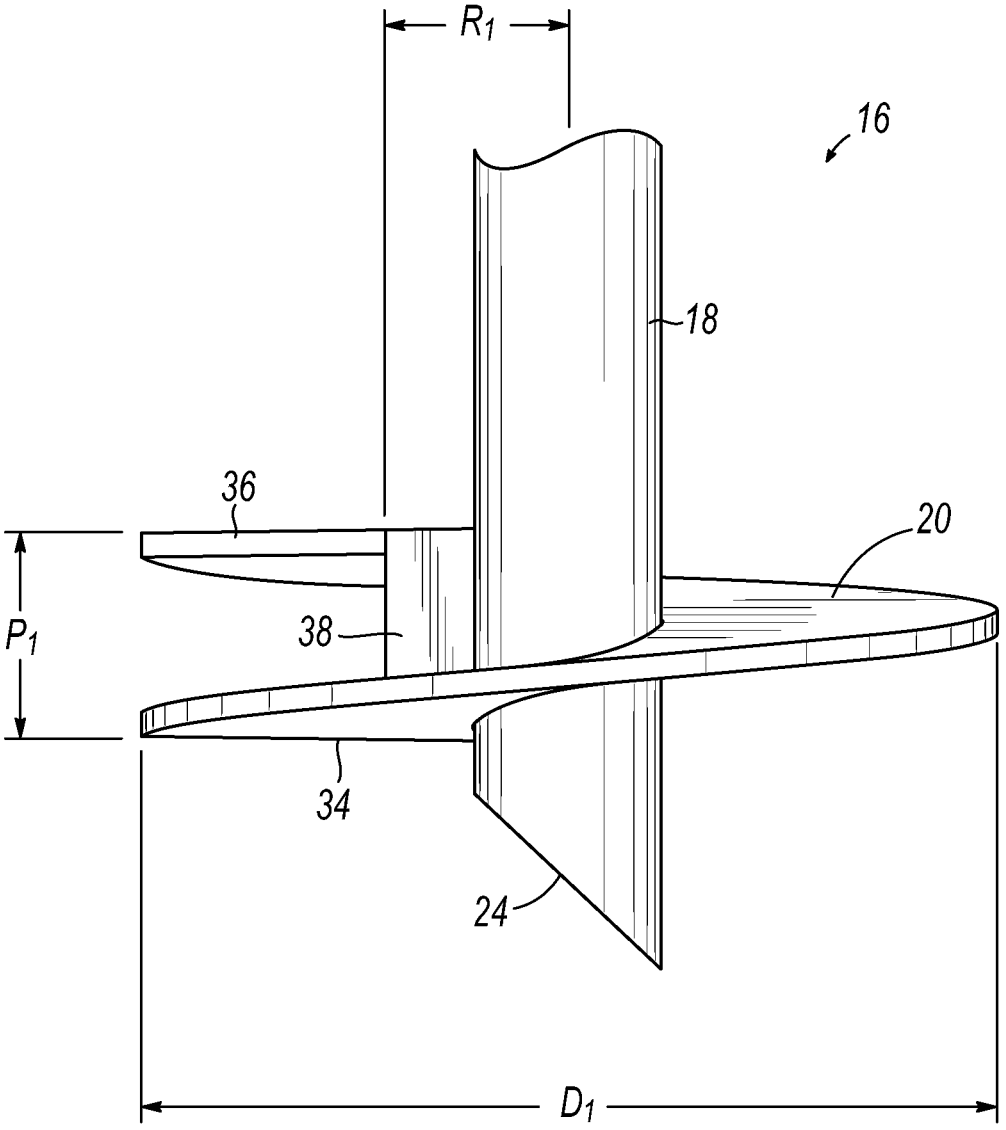
FIG. 5 is an enlarge fragmentary view of the leading end thereof.
Figure 8:
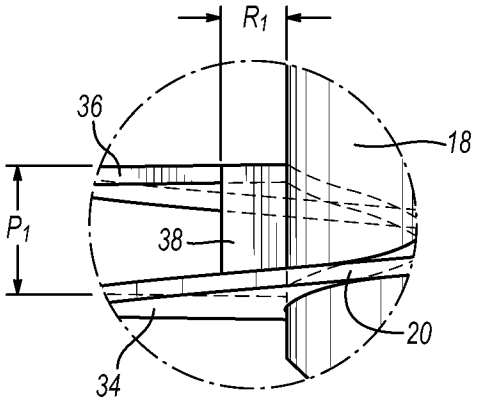
FIG. 8 is an enlarged detailed view of the area labeled 8 in FIG. 6.

As is well-known in the field of pile foundations, a helical pile can be grouted in place by flowing fluid grout around the pile shaft as it is being installed and allowing the grout to cure in place before securing a structure, such as a reinforced concrete slab or structural building member, to the upper or proximal end of the pile shaft. As used herein, "grout" can include any suitable Portland cement, chemical, or pozzolanic material that is flowable in an uncured state that hardens to a solid, load-bearing state when cured, as is well-known in the industry. This method is described in U.S. Pat. Nos. 5,707,180 and 6,058,662, the contents of which are hereby incorporated by reference, and later patents. Referring first to FIGS. 1-3, a helical pile 10 may be driven into the soil 12 using a requisite number of extension shafts 14 to provide a length as needed to achieve minimum depth and/or torque according to known standards and engineering requirements for the particular location, soil composition, and intended use.

The leading section 16 of the helical pile 10 includes an elongated shaft 18 and one or more helices 20, 22 comprising a helical flange radially extending from the shaft 18 to a predetermined diameter. The leading section 16 includes a leading end or tip 24. The shaft 18 can have a round, square, tubular, or other cross-sectional shape. A feature shown in FIG. 1 (described in more detail below) of a displacement paddle 38 affixed to at least the leading helix 20 radially displaces or compresses the soil 12 as it is driven downwardly to form a grout column channel 26 around the shaft 18. Second and subsequent helix 22 also can contain a displacement paddle 38 affixed thereto. The displacement paddle 38 can be the same size in helix 20 and subsequent helices 22, or it can vary in size with preference to gradually increasing width from lead helix to subsequent. Helices 20, 22 can be clocked 180 degrees apart for moment balancing as shown in FIGS. 1-3 and as taught in U.S. Pat. No. 6,058,662, or they can align on the same side of the shaft. Likewise, soil displacement paddles 38 can be clocked 180 degrees apart for moment balancing as shown in FIGS. 1-3, or they can align. The displacement paddle 38 extends from the shaft 18 outward toward the outer circumference of the helix 20, 22. The orientation may be exactly radial or can be offset from an exact radial direction. The paddle 38 can follow and connect a portion of the leading edge 34 of a helix 20, 22 to a portion of the trailing edge of the same helix 20, 22, or can be offset from the leading and trailing edges 34, 36.

As is well-known, soil also can be displaced to create a grout column using one or more grout pushing piston discs 61 as shown in FIG. 2. Such a pushing piston disc 61 can be in addition to or in lieu of displacement paddles 38. In the embodiments shown in FIGS. 1 and 2, near the surface of the soil 12, a grout reservoir 28 may be formed so that a supply of flowable grout 29 can pool and be available to be pulled into the grout column 26 as the helical pile 10 is being installed. Soil also can be displaced to create a grout column using grout pumped under pressure through holes 61 spaced along the shaft 18. Using pressure, grout 29 is pumped down the shaft 18 and out holes 61 to displace the soil and fill the grout channel 26 as shown in FIG. 3. After installation, grout may be allowed to cure in the grout reservoir 28, if any, and channel 26, providing additional strength, lateral, and buckling support to the shaft 14, 18. An end cap connector 30 of a variety of known types may be fixed to the upper end of the shaft 14 for connection to a reinforced concrete pile cap 32 or other structure being supported by the helical pile 10.

Referring now to FIGS. 4-8, the leading section 16 of a helical pile will include a first or leading helical flange or helix 20 adjacent the leading end or tip 24. The helix 20 is typically a metal flange that is welded or otherwise secured to the shaft 18 having a predetermined pitch $P_1$ that determines the rate at which the pile 10 can be driven, like an auger or screw, into the soil 12. Each helix 20 has a leading edge 34 that cuts into the soil as the shaft 18 is rotated and a trailing edge 36 at the opposite end of the flange. Generally, each helix 20 has a predetermined diameter $D_1$ and circumscribes approximately one revolution from leading edge 34 to trailing edge 36. In some cases, a helix 20 could extend less than a full revolution or more than a full revolution. In this case, the space ($P_1$) between the leading and trailing edges 34, 36 defines a flute or the pitch of the helix 20. Additional helices 22 may be provided at intervals axially spaced along the shaft 18. In some cases, such as that illustrated, a following helix 22 may have a larger over all diameter $D_2$ than that of the leading helix 20. For example, the leading helix could have a diameter $D_1$ of 12 inches with a pitch $P_1$ of 3 inches on a shaft 18 that is 3 inches in diameter. The second or successive helices 22 may have a diameter $D_2$ of 14 inches with a pitch of 3 inches.

Particular to the present invention, a soil displacement paddle 38 may extend radially from the shaft 18 and extend axially between a portion of the leading and trailing edges 34, 36 spanning part or all of the pitch of the helix 20. The soil displacement paddle 38 extends radially less than the full diameter $D_1$ of the helix 20, 22 in order to form a grout column channel 26, while allowing a significant area of the helix plate 20, 22 to remain engaged in the surrounding soil 12. For example, the soil displacement plate 38 could extend approximately 1.5 inches radially outward from the shaft 18 (having a radial extension $R_1$, shown in FIG. 6) in order to form a channel 26 approximately 6 inches in diameter to form the grout column 26. This design is mechanically simple and easy to manufacture, making the cost of manufacturing low, while being more effective and durable than other designs for soil displacement devices. Unlike some other prior art systems, the present invention allows the pile 10 to be grouted along nearly its entire length, including the leading section 16.

To the extent that the soil displacement plate 38 of second or subsequent helices 22 proximal to a leading helix 20 does not extend radially beyond the soil displacement plate 38 of the leading helix 20, it will not significantly further enlarge the diameter of the grout column channel 26 and will act to push or retain fluid grout in the channel 26 distal of the helix 22. A larger soil displacement plate 38 that extends a further radius (not shown) from the shaft 18 could be used to enlarge the diameter of the grout column channel 26.

Figure 7:
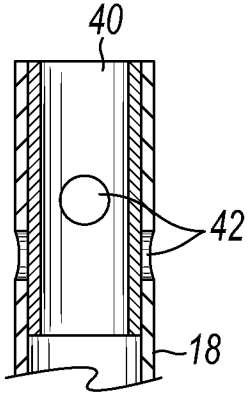
FIG. 7 is a fragmentary sectional view taken substantially along line C-C of FIG. 6.
Figure 6:
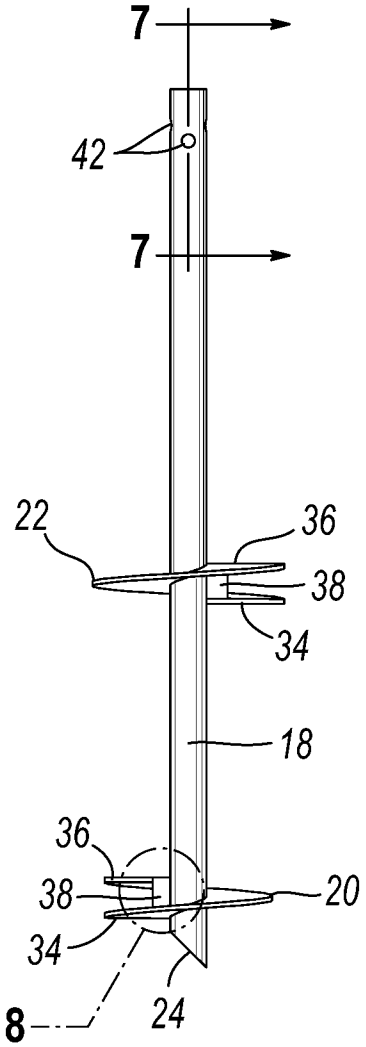
FIG. 6 is a side plan view thereof.
Figure 10:
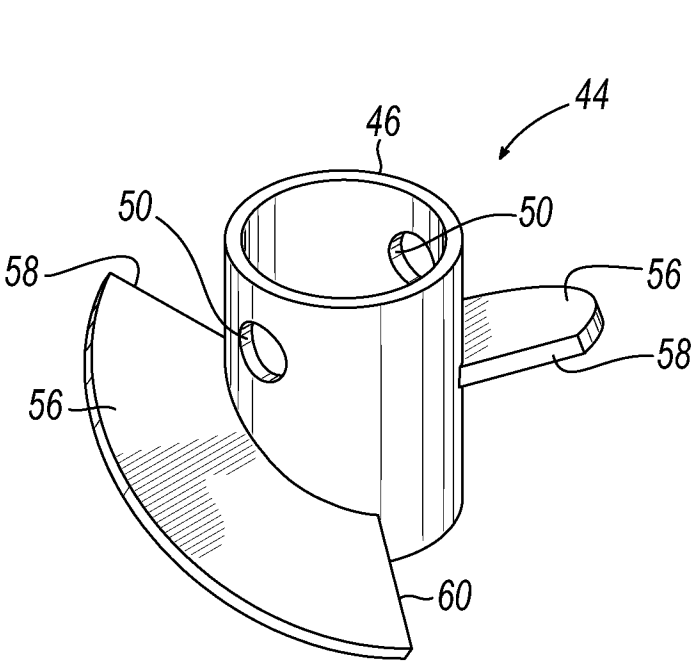
FIG. 10 is an isometric view of the grout displacement propeller according to an embodiment of the invention.

As shown in FIG. 7, the upper or proximal end of the shaft 18 may include a reinforced attachment portion in which the wall of the shaft 18 is reinforced by an inner tube 40 in the area adjacent the upper end. This portion includes one or more cross-bore openings 42 for coupling the leading section 16 to an extension shaft 14.

Referring now also to FIGS. 9-13, another aspect or embodiment of the present invention is the provision of a grout propeller 44 to actively convey flowable grout 29 downward through the channel of the grout column 26 to enhance uniform distribution and eliminate voids. According to an embodiment and aspect of the present invention, a grout propeller 44 positioned proximal to the leading section 16 can actively draw fluid grout 29 from the grout reservoir 28 and propel and force it downwardly in the grout column channel 26.

Figure 9:
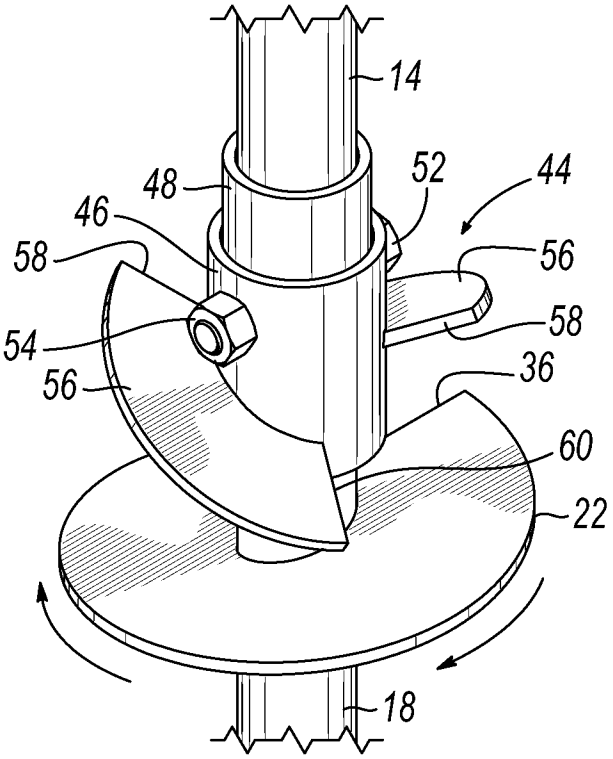
FIG. 9 is an isometric view of a grout displacement propeller shown installed at a connection between an upper end of a helical pile lead section and an extension shaft section.
Figure 11:
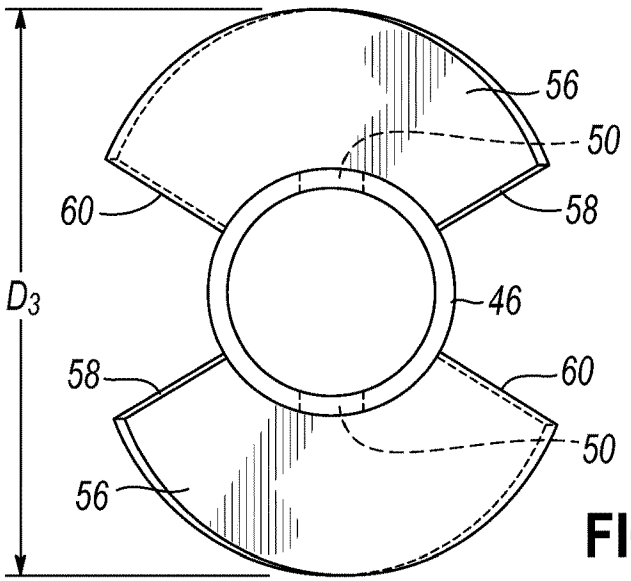
FIG. 11 is a top plan view thereof.
Figure 13:
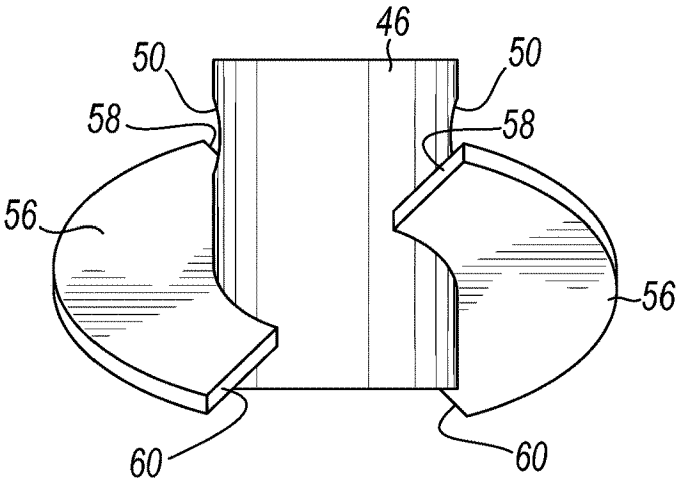
FIG. 13 is a second side view thereof, shown axially rotated 90 degrees relative to the view of FIG. 12.
Figure 12:
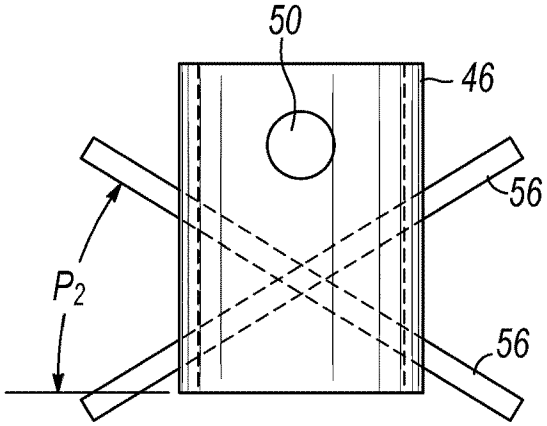
FIG. 12 is a first side view thereof.

A grout propeller 44 may be used at selected intervals along the shaft 18 of the lead section 16 and/or extension shaft 14 sections. Likewise, as shown in FIGS. 1 and 9, a grout propeller 44 may be secured where adjacent shaft sections 14, 18 are coupled. The illustrated embodiment includes a tubular, substantially cylindrical body 46 that may be sized to axially fit over and connect to a pile shaft 14, 18 or a coupler 48 used to connect adjacent shaft members 14, 18. For example, the body may include cross bore openings 50 that are sized to receive a fastener, such as a threaded bolt 52 and nut 54 combination, used to couple adjacent shaft sections 14, 18.

The grout propeller 44 includes one or more semi-circular blades 56 that extend radially from the body 36. Notably, the pitch angle of the grout propeller blades 56 is shown opposite that of the helices 20, 22. Thus, the leading edge 58 of the blade 56 is positioned higher or proximal relative to the trailing edge 60. In the illustrated embodiment, the semi-circular blades 56 of the grout propeller 44 can be less than a full circumference, such as one-third, and may be positioned opposite another semi-circular blade 56. Notably, the pitch $P_2$ of the grout propeller blades 56 may be significantly greater than that of the boring helices 20, 22 on the leading section 16. In the illustrated embodiment, the pitch angle of each grout propeller blade 56 may be 30 degrees relative to transverse of the pile shaft 14, 18, for example. The diameter $D_3$ of the grout propeller blades 56 may be approximately the same as, or slightly larger or smaller than, the diameter of the grout column channel 26. In this manner, the grout propeller 44 may not be intended to significantly cut into the soil 12 or modify the diameter of the grout column channel 26, but rather the propeller 44 draws fluid grout 29 downwardly from the grout reservoir 28 or grout holes 62 and propels or compacts grout 29 within the grout column channel 26 as it rotates with the shaft 14, 18. The modular nature of the grout propeller 44 according to this embodiment allow the user to select both the number and placement of the propellers 44 along the pile 10. It is also simple to manufacture and can be transported separately from the extension shafts 14, allowing selective assembly on site.

Accordingly, when rotational force is applied to the proximal or upper end of the pile shaft 14, 18 (as shown by arrows in FIG. 9), the lead and/or secondary helices 20, 22 cut through the soil 12 to draw the pile 10 downward. The soil displacement plate(s) radially compacts the soil 12 to form a grout column channel 26 around the pile shaft 18 and to assist in drawing fluid grout 29 from the grout reservoir 28 to surround the shaft 18 of the leading section 16. Grout propellers 44 spaced at intervals along the pile shaft 14, 18, such as at connections between shaft sections, can draw fluid grout 29 from the grout reservoir 28 (which is being refilled as needed during the process) and compacts the grout 29 to eliminate voids. This is enhanced by the pitch $P_2$ of the propeller blades 56 being greater than the pitch $P_1$ of the helices 20, 22, the latter of which determines the axial advancement rate at which the pile is driven into the soil 12. Once the pile 10 and fluid grout 29 are in place, the grout is allowed to cure, forming a ridged foundation pier having a wide variety of uses and applications.

Figure 17A:
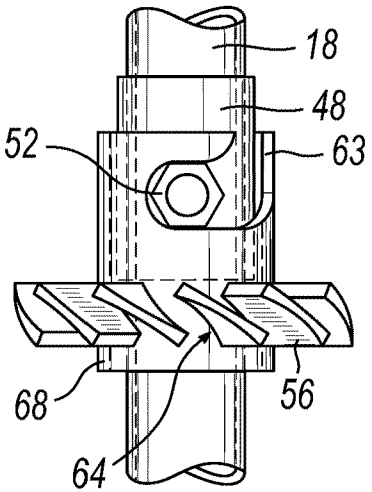
FIGS. 17A and 17B are side elevation and top plan views, respectively, of a grout propeller according to yet another embodiment of the invention showing multiple propeller blades.
Figure 17B:
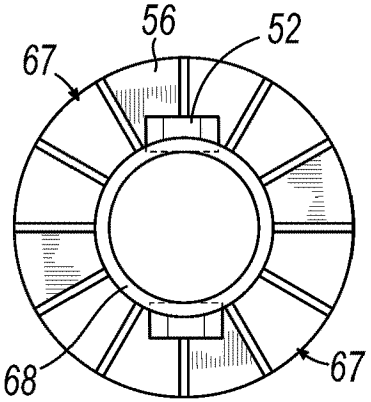
Figure 16A:
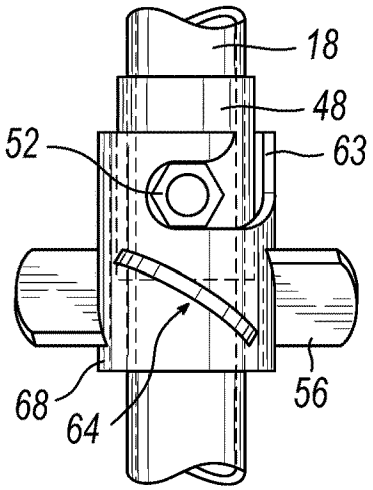
FIGS. 16A and 16B are side elevation and top plan views, respectively, of a grout propeller according to another embodiment of the invention showing curved propeller blades.
Figure 16B:
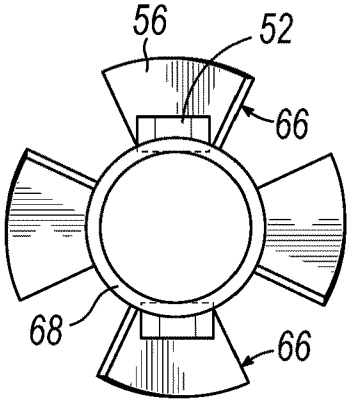
Figure 15A:
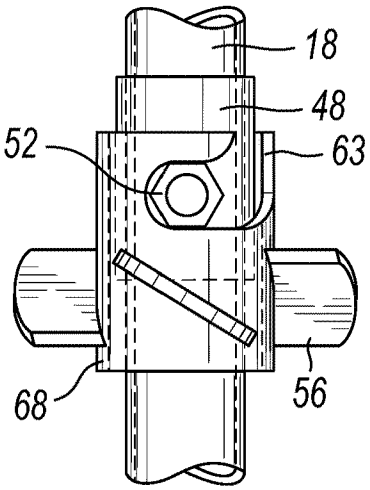
FIGS. 15A and 15B are side elevation and top plan views, respectively, of a grout propeller according to still another embodiment of the invention showing four propeller blades.
Figure 15B:
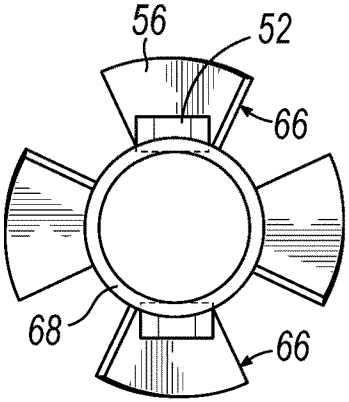
Figure 14A:
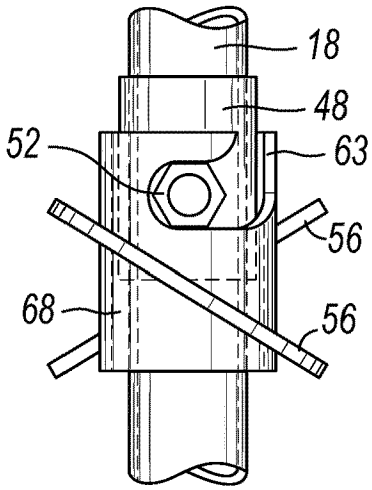
FIGS. 14A and 14B are side elevation and top plan views, respectively, of a grout propeller according to another embodiment of the invention with a bolt and slotted connection.
Figure 14B:
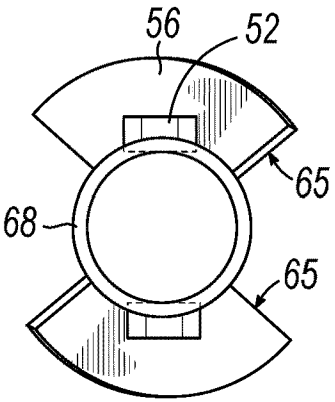

Referring to the views of FIGS. 14-17, attachment of the grout propellers 56 to the pile shaft 18 can be via an "L"-shape slot 63 that slides over and locks to the pile coupling bolt 52, providing a bayonet-type connection. Other embodiments may include direct welding, mechanical fasteners of various sorts, or other connections. Propellers 56 may be attached to a collar 68 placed over the shaft 18, or propellers 56 may be affixed directly to the shaft 18. Grout propellers 56 may consist of one plate or two opposed semi-circular plates 65 as shown in FIGS. 14A and 14B, or any number of propeller blades, such as four 66 or more 67 as shown in FIGS. 15-17. Grout propellers 56 may be flat as in FIGS. 14 and 15, or they 56 may be curved, cupped, or otherwise shaped 64 in order to better propel grout similar to a fluid turbine as shown in FIGS. 16 and 17.

While one or more embodiments of the present invention have been described in detail, it should be apparent that modifications and variations thereto are possible, all of which fall within the true spirit and scope of the invention. Therefore, the foregoing is intended only to be illustrative of the principles of the invention. Further, since numerous modifications and changes will readily occur to those skilled in the art, it is not intended to limit the invention to the exact construction and operation shown and described. Accordingly, all suitable modifications and equivalents may be included and considered to fall within the scope of the invention, defined by the following claim or claims.

What is claimed is:

1. A helical pile, comprising:

an elongated shaft;

at least one helical blade having a leading edge and a trailing edge on the shaft;

a displacement paddle extending outward from the shaft longitudinally positioned to extend from the leading edge to the trailing edge of the at least one helical blade to push away soil to create a grout channel surrounding the shaft; and at least one grout propeller on the shaft, the at least one grout propeller having at least one grout propeller blade pitched in an opposite direction from the helical blade to propel grout downward in the grout channel as the pile rotates.

2. The pile of claim 1, further comprising at least a second helical blade and a second displacement paddle.

3. The pile of claim 2, wherein the displacement paddle and second displacement paddle are arranged consecutively and the displacement paddles are clocked 180 degrees from one another.

4. The pile of claim 2, wherein the second displacement paddle extends outwardly a greater distance than the displacement paddle.

5. The pile of claim 1, wherein the grout propeller has at least two blades.

6. The pile of claim 1, wherein the grout propeller blade has a pitch greater than the pitch of the helical blade.

7. The pile of claim 1, wherein the grout propeller blade has a flat profile.

8. The pile of claim 1, wherein the grout propeller blade extends outwardly approximately the same distance as the grout channel.

9. The pile of claim 1, wherein the grout propeller blade has a curved profile.

10. The pile of claim 5, wherein multiple grout propeller blades are arranged circumferentially spaced at a common axial position around a cylindrical body such that a leading edge of one blade is approximately vertically aligned with a trailing edge of an adjacent blade.

11. The pile of claim 1, wherein the grout propeller is fastened directly to the shaft.

12. The pile of claim 1, wherein the grout propeller includes a cylindrical body to which the grout propeller blade is attached and the cylindrical body is fixed to the shaft at a selected position by a mechanical fastener.

13. The pile of claim 12, wherein the shaft includes segment couplings and the cylindrical body is attached to the shaft at a coupling location.

14. The pile of claim 12, wherein the cylindrical body includes an L-shape slot that engages the fastener to provide a bayonet-type connection.

15. A method of installing a grouted helical pile, comprising:

providing a helical pile having an elongated shaft, at least one helical blade on the shaft having a leading edge and a trailing edge, and a displacement paddle extending outward from the shaft, the paddle being longitudinally positioned to extend from the leading edge to the trailing edge of the at least one helical blade to push away soil to create a grout channel surrounding the shaft;

providing the shaft with at least one grout propeller, the at least one grout propeller having at least one blade pitched in an opposite direction from the helical blade to propel grout downward in the grout channel as the pile rotates;

rotating the pile to drive the pile into soil;

providing a grout reservoir at the soil surface where the pile is being installed; and adding fluid grout to the reservoir to flow into the grout channel.

16. The method of claim 15, further comprising providing more than one grout propeller spaced along the shaft, thereby increasing pressure of the grout conducted down along the shaft and maintaining grout column hole stability.

17. The method of claim 15, wherein the grout propeller includes multiple blades circumferentially spaced at an axial position around a cylindrical body such that a leading edge of one blade is approximately vertically aligned with a trailing edge of an adjacent blade.

18. The method of claim 15, wherein the shaft is a hollow shaft that includes grout ports, and further providing simultaneously pumping grout down the shaft under pressure and out the grout ports as the pile is rotated into the soil.

19. A method of installing a grouted helical pile, comprising:

providing a helical pile having an elongated hollow shaft with grout ports, at least one helical blade on the shaft having a leading edge and a trailing edge, and a displacement paddle extending outward from the shaft, the paddle being longitudinally positioned to extend from the leading edge to the trailing edge of the at least one helical blade to push away soil to create a grout channel surrounding the shaft;

providing the shaft with at least one grout propeller, the at least one grout propeller having at least one blade pitched in an opposite direction from the helical blade;

rotating the pile to drive the pile into soil; and simultaneously pumping grout down the shaft under pressure and out the grout ports as the pile is rotated into the soil, the grout propeller propelling grout downward in the grout channel as the pile rotates.

* * * * *